US009506005B2

(12) United States Patent
David et al.

(10) Patent No.: US 9,506,005 B2
(45) Date of Patent: Nov. 29, 2016

(54) GREASE COMPOSITION AND METHODS FOR MANUFACTURING THE GREASE COMPOSITION

(75) Inventors: Sébastien David, Ouderkerk a/d Amstel (NL); Franciscus Catherina Martinus Fiddelaers, Ijsselstein (NL)

(73) Assignee: AKTOEBOLAGET SKF, Gothenburg (SE)

( * ) Notice: Subject to any disclaimer, the term of this patent is extended or adjusted under 35 U.S.C. 154(b) by 774 days.

(21) Appl. No.: 13/387,069

(22) PCT Filed: Aug. 3, 2010

(86) PCT No.: PCT/EP2010/004734
§ 371 (c)(1),
(2), (4) Date: Feb. 27, 2012

(87) PCT Pub. No.: WO2011/015337
PCT Pub. Date: Feb. 10, 2011

(65) Prior Publication Data

US 2012/0149613 A1 Jun. 14, 2012

(30) Foreign Application Priority Data

Aug. 5, 2009 (EP) ..... 2009/005662
Aug. 5, 2009 (EP) ..... 2009/005663
Aug. 5, 2009 (EP) ..... 2009/005664

(51) Int. Cl.
*C10M 169/06* (2006.01)
*C10M 113/02* (2006.01)
*C10M 115/04* (2006.01)
*C10M 123/02* (2006.01)

(52) U.S. Cl.
CPC ..... *C10M 123/02* (2013.01); *C10M 2201/085* (2013.01); *C10M 2201/1056* (2013.01); *C10M 2203/1006* (2013.01); *C10M 2205/0285* (2013.01); *C10M 2207/1265* (2013.01); *C10M 2207/1285* (2013.01); *C10M 2215/223* (2013.01); *C10M 2223/043* (2013.01); *C10M 2223/047* (2013.01); *C10M 2223/061* (2013.01); *C10N 2210/01* (2013.01); *C10N 2210/02* (2013.01); *C10N 2220/08* (2013.01); *C10N 2220/082* (2013.01); *C10N 2230/06* (2013.01); *C10N 2230/12* (2013.01); *C10N 2240/02* (2013.01); *C10N 2250/10* (2013.01); *C10N 2270/00* (2013.01)

(58) Field of Classification Search
CPC ..... C10M 2207/129; C10N 2250/10; B82Y 30/00
USPC ..... 508/144, 136; 977/773
See application file for complete search history.

(56) References Cited

U.S. PATENT DOCUMENTS

| | | | | |
|---|---|---|---|---|
| 2,514,331 | A | 7/1950 | Morway | |
| 2,573,650 | A | 10/1951 | Peterson | |
| 4,294,713 | A * | 10/1981 | Knollmueller et al. | 508/136 |
| 4,902,435 | A | 2/1990 | Waynick | |
| 6,010,985 | A | 1/2000 | Heimann et al. | |
| 2003/0087768 | A1 | 5/2003 | Florchinger | |
| 2005/0133265 | A1 | 6/2005 | Denton | |
| 2011/0136709 | A1* | 6/2011 | Tanaka et al. | 508/144 |

FOREIGN PATENT DOCUMENTS

GB 775027 A 5/1957

OTHER PUBLICATIONS

CAB-O-Sil TS-720 Treated Fume Silica Jan. 2006; Cabot Corporation XP007917151.

* cited by examiner

*Primary Examiner* — Vishal Vasisth
(74) *Attorney, Agent, or Firm* — Bryan Peckjian; SKF USA Inc. Patent Dept.

(57) ABSTRACT

The present invention relates to a non-hydroxide grease composition comprising a base oil and a thickener which comprises amorphous hydrophilic silicon oxide particles and one or more metal salts of different organic acids, wherein the silicon oxide particles have a BET specific surface area of at least 50 $m^2/g$ and wherein the amount of the metal salt(s) is 4-25% by weight, based on the total weight of the grease composition. The present invention further relates to a method for manufacturing said grease composition and the use of said grease composition for lubricating a bearing and in couplings and gearings.

12 Claims, No Drawings

GREASE COMPOSITION AND METHODS FOR MANUFACTURING THE GREASE COMPOSITION

CROSS-REFERENCE

This application is the US national stage of International Application No. PCT/EP2010/004734, filed on Aug. 3, 2010, which claims priority from the following three International Applications: PCT/EP2009/005662, PCT/EP2009/005663 and PCT/EP2009/005664, all filed on Dec. 5, 2009.

FIELD OF THE INVENTION

The present invention relates to a grease composition and to methods for manufacturing the grease composition. The present invention further relates to the use of the grease composition for lubricating a bearing and to the use of the grease composition in gears and couplings.

BACKGROUND OF THE INVENTION

Grease compositions are widely used for lubricating bearings and other structural components. A grease is an essential product to reduce, for example, wear, friction, running temperatures and energy losses.

Greases are materials which comprise a base oil that is thickened with a metal soap, and they are usually prepared by reacting a metal hydroxide with a fatty acid in the presence of the base oil. Conventional metal soap greases require an energy intensive grease cooking and milling process in order to achieve proper thermal mechanical stability. Conventional metal soap greases can still be sensitive to poor thermal mechanical stability and can require additional treatments. It is known to improve further the stability, and thus the lubricating capacity, of conventional greases by adding solid additives during the thickening process. Examples of such solid additives are, for example, molybdenum disulfide, graphite, zinc oxide and/or a silica gel. The process of grease cooking and milling and additional treatments is relatively expensive because it is carried out at an elevated temperature over a relatively long period of time. Moreover, the greases so prepared are still unsuitable for a variety of applications, and not all conventional greases are suitable for food and beverage processing applications because they contain considerable amounts of metal hydroxides. In this respect reference is for instance made to U.S. Pat. No. 2,514,331 in which a lime soap grease is prepared by cooking lime and an animal fat at an elevated temperature. The lime soap grease thus prepared typically needs an excess amount of lime to completely neutralize the large variety of fatty acids that are present in the grease. Moreover, it is noted that the performance of such lime soap greases leaves much room for improvement. A soap grease is also known from US 2003/0087768 which comprises a base oil, a thickener comprising a complex lithium soap, and an agent for reducing the coefficient of friction which comprises hydrophobic silica. The soap grease so prepared also contains a considerable amount of metal hydroxide, whereas the grease lubricating properties leave considerable room for improvement.

Consequently, there is a need for greases which can easily be manufactured at low costs (i.e. low temperatures), which are stable and show highly attractive lubricating properties. In addition, there is a need for greases that are biodegradable, environmentally friendly and food compatible.

SUMMARY OF THE INVENTION

Object of the present invention is to provide a grease composition which shows excellent lubricating properties, which can easily be manufactured at low temperatures and which is more environmental friendly.

Surprisingly, it has now been found that this can be established when use is made of a thickener which comprises specific silicon oxide particles and one or more metals salts of different organic acids.

Accordingly, the present invention relates to a non-hydroxide grease composition comprising a base oil and a thickener which comprises amorphous hydrophilic silicon oxide particles and one or more metal salts of different organic acids, wherein the silicon oxide particles have a BET specific surface area of at least 50 $m^2/g$ and wherein the amount of the metal salt(s) is 4-25% by weight, based on the total weight of the grease composition.

The present invention also relates to methods for manufacturing such a grease composition, and the use of such a grease composition for lubricating a bearing, a gearing or a coupling.

In the context of the present invention, a non-hydroxide grease composition is defined as a grease composition which contains less than 0.5% by weight of free hydroxide ions and/or metal hydroxide, based on the total weight of the grease composition.

DETAILED DESCRIPTION OF THE INVENTION

The Silicon Oxide Particles

The silicon oxide particles to be used in accordance with the present invention are amorphous hydrophilic silicon oxide particles. The amorphous silicon oxide may contain various amounts of water, implying that it may comprise silicic acid. In this respect it is noted that silicic acid is a general name for a group of chemical compounds, oligomers and polymers consisting of silicon, hydrogen, and oxygen.

According to a preferred embodiment of the present invention, the amorphous silicon oxide particles are amorphous hydrophilic fumed silicon oxide. Fumed silicon oxide is an exceptionally pure form of silicon oxide made from silica tetrachloride as a starting material, as is well known in the art. Preferably, the silicon oxide to be used in accordance with the present invention has a purity level of at least 98%. Suitable sources for the fumed silicon oxide are Aerosil® which is commercially available from Evonik Industries (formerly known as Degussa) or Cap-o-Sil® which is commercially available from Cabbot Corporation.

The amorphous hydrophilic silicon oxide particles have a BET specific surface area of at least 50 $m^2/g$; preferably at least 75 $m^2/g$, more preferably at least 100 $m^2/g$, even more preferably at least 125 $m^2/g$ and most preferably at least 150 $m^2/g$. Although is it preferred that the BET specific surface area is as high as possible, it will usually not be higher than 500 $m^2/g$. Hence, suitably the BET specific surface is in the range of from 50-500 $m^2/g$; more preferably in the range of from 75-500 $m^2/g$, yet even more preferably in the range of from 100-500 $m^2/g$, even yet more preferably in the range of from 125-500 $m^2/g$ and most preferably in the range of from 150-500 $m^2/g$. Methods for determining the BET specific surface area are well known in the art.

According to the present invention, it is also preferred that at least 80%, more preferably at least 90%, of the amorphous hydrophilic silicon oxide particles have a mean particle size of 5-50 nm, preferably of 5-40 nm, more preferably of 5-35 nm and most preferably of 5-25 nm. The mean particle size distribution of the amorphous hydrophilic silicon oxide particles is preferably in the range of 1-50 nm.

The One or More Metal Salts of Different Organic Acids

According to the present invention, use is made of one or more metal salts of different organic acids. In accordance with the present invention the one or more metal salts of different organic acids are preferably prepared from organic acids that are substantially pure organic acids. In this context, the term "substantially pure" means at least 95% by weight pure, i.e. the respective organic acids contain less than 5% by weight of other organic acids. Preferably, the organic acids contain less than 1% by weight of other organic acids, more preferably less than 0.5% by weight, even more preferably less than 0.2% by weight of other organic acids. Most preferably, the one or more metal salts are prepared from organic acids that are entirely pure. Hence, in accordance with the present invention preferably use is made of synthetic organic acids to prepare the one or more metal salts. The one or more metal salts to be used in accordance with the present invention are substantially pure metal salts. In this context, "substantially pure" means at least greater than 99% by weight pure, i.e. respective metal salts contain less than 1% by weight of free hydroxide, metal hydroxide and/or free organic acids. Preferably, the respective metal salts contain less than 0.5% by weight, more preferably less than 0.2% by weight of free hydroxide, metal hydroxide and/or free organic acids. Most preferably the one or more metal salts of the organic acid are entirely pure.

The grease compositions in accordance with the present invention do not contain impurities such as excess amounts of hydroxide which are normally present in greases that are prepared in conventional lime soap manufacturing processes. The grease compositions according to the present invention are suitably substantially free of free hydroxide ions and/or metal hydroxide. Preferably, the present grease compositions contain less than 0.2% by weight, and more preferably less than 0.1% by weight of free hydroxide ions and/or metal hydroxide, based on the total weight of the grease composition. Most preferably, the present grease compositions are completely free of free hydroxide ions and/or metal hydroxide. The grease compositions according to the present invention are suitably substantially free of metal hydroxide. Preferably, the present grease compositions contain less than 0.2% by weight, and more preferably less than 0.1% by weight of metal hydroxide, based on the total weight of the grease composition. Most preferably, the present grease compositions are completely free of metal hydroxide. Preferably, the present grease compositions contain less than 1.0% by weight, more preferably less than 0.5% by weight, and even more preferably less than 0.2% by weight of free organic acids, based on the total weight of the grease composition. It will be understood that OH-groups present on the silicon oxide or in an organic acid such as 12-hydroxy stearate or the metal salt of such an organic acid are not to be considered free hydroxide ions since they are bonded to silicon atoms or to a carbon atom of the organic acid.

The thickener used in accordance with the present invention comprises the amorphous hydrophilic silicon oxide particles and the one or more metal salts of different organic acids. The thickener is preferably a non-saponified thickener.

The organic acids to be used in accordance with the present invention may be aliphatic monocarboxylic acids or aliphatic dicarboxylic acids. The organic acid may be unbranched, branched, saturated or unsaturated organic acid. Preferably, the organic acid to be used in accordance with the present invention is a fatty acid.

In the present invention use is made of one or more metal salts of different organic acids. Suitably, use can be made of a plurality of metal salts of different organic acids. In case use is made of a plurality of metal salts of different organic acids suitably use is made of a relatively small number of such metal salts. Suitably, use is made of less than seven metal salts of different organic acids, preferably less than six metals salts of different organic acids. Such metal salts differ from metal salts that are derived from substances such as animal fats which contain relatively high amounts of different fatty acids. Preferably, at most four metal salts of different organic acids are used in the grease compositions according to the present invention. More preferably, at most three metal salts of different organic acids are used.

In a particular attractive embodiment, the grease composition according to the present invention comprises one type of metal salt of an organic acid. According to the present invention, preferably use is made of one metal salt of an organic acid comprising 18 carbon atoms. Such a grease composition is attractive for various speed ranges, even high speed applications such as turbines and electromotors. The organic acid of the metal salt may be stearic acid, 12-hydroxy stearic acid or oleic acid. Preferably, the organic acid of the metal salt is stearic acid or 12-hydroxy stearic acid. Most preferably, the organic acid of the metal salt is 12-hydroxy stearic acid which acid is able to form covalent bonds with OH-groups (silanol) of amorphous hydrophilic fumed silicon oxide, resulting in a very attractive performance of the grease composition in terms of thermal mechanical stability. Accordingly, the present grease composition suitably comprises a base oil and a thickener which comprises amorphous hydrophilic silicon oxide particles and at least a metal salt of 12-hydroxy stearic acid, wherein the silicon oxide particles have a BET specific surface area of at least 50 $m^2/g$ and wherein the amount of the metal salt(s) is 4-25% by weight, based on the total weight of the grease composition.

In another attractive embodiment of the present invention, the grease composition comprises two types of metal salts of different organic acids. Accordingly, such a grease composition comprises a first s metal salt of an organic acid and a second metal salt of an organic acid, wherein the organic acid of the first metal salt and the organic acid of the second metal salt comprise a different number of carbon atoms. Preferably, the organic acid of the first metal salt comprises 2-16 carbon atoms and the organic acid of the second metal salt comprises 20-24 carbon atoms. Suitably, the organic acid of the first metal salt is butyric acid, caproic acid, caprylic acid, capric acid, lauric acid, myristic acid or palmitic acid, preferably caproic acid or caprylic acid. Suitably, the organic acid of the second metal salt is arachidic acid, behenic acid or lignoceric acid. Such a grease composition is particularly attractive in low speed applications such as mining and cement applications. Preferably, the amount of the first metal salt is 0.1-15% by weight and the amount of the second metal salt is 0.1-15% by weight, based on the total weight of the grease composition. More preferably, the amount of the first metal salt is 0.5-8% by weight and the amount of the second metal salt is 0.5-8% by weight, based on the total weight of the grease composition. If the first metal salt is present in a higher amount than the second metal salt, the grease composition will display improved performances at lower speed rates. If the second metal salt is present in a higher amount than the first metal salt then the grease composition will display improved performances at low temperatures.

In another attractive embodiment of the present invention, the grease composition comprises two metal salts of different organic acids, wherein the organic acids of the first and second metal salts both comprise 18 carbon atoms. Suitably, the organic acids of the first and second metal salts are selected from stearic acid, oleic acid and 12-hydroxy stearic acid. Preferably, use is made of a first metal salt of 12-hydroxy stearic acid and a second metal salt of stearic acid. As indicated before, the metal salt of 12-hydroxy stearic acid will be able to form covalent bonds with OH-groups (silanol) of amorphous hydrophilic fumed silicon oxide resulting in a very attractive performance of the grease composition in terms of thermal mechanical stability. Preferably, the amount of such a first metal salt is 0.1-15% by weight and the amount of a second metal salt is 0.1-15% by weight, based on the total weight of the grease composition. More preferably, the amount of such a first metal salt is 0.5-8% by weight and the amount of such a second metal salt is 0.5-8% by weight, based on the total weight of the grease composition.

In another embodiment of the present invention, the grease composition comprises three types of metal salts of different organic acids. Accordingly, such a grease composition comprises a first metal salt of an organic acid, a second metal salt of an organic acid and a third metal salt of an organic acid, wherein the organic acid of the first metal salt, the organic acid of the second metal salt and the organic acid of the third metal salt each comprise a different number of carbon atoms. Preferably, the organic acid of the first metal salt comprises 2-16 carbon atoms, preferably 6-8 carbon atoms, the organic acid of the second metal salt comprises 20-24 carbon atoms, and the organic acid of the third metal salt comprises 18 carbon atoms. Suitably, the organic acid of the first metal salt is butyric acid, caproic acid, caprylic acid, capric acid, lauric acid, myristic acid or palmitic acid, preferably caproic acid or caprylic acid. Suitably, the organic acid of the second salt is arachidic acid, behenic acid or lignoceric acid. Preferably, the organic acid of the third metal salt is any of the organic acids comprising 18 carbon atoms as described hereinabove. Most preferably, the organic acid of the third metal salt which comprises 18 carbon atoms is 12-hydroxy stearic acid. AS mentioned before, the metal salt of 12-hydroxy stearic acid is able to form covalent bonds with OH-groups (silanol) of amorphous hydrophilic fumed silicon oxide, resulting in a very attractive performance of the grease composition in terms of thermal mechanical stability. Such a grease composition is particularly attractive in a diversity of industrial and automotive applications such as in mining, steel, fans, electrical motors, wheel bearings, agricultural, conveyors, bakery equipment and food processing. Preferably, the amount of the first metal salt is 0.1-8% by weight, the amount of the second metal salt is 0.1-8% by weight and the amount of the third metal salt is 1-15% by weight, based on the total weight of the grease composition. More preferably, the amount of the first metal salt is 0.5-5% by weight, the amount of the second metal salt is 0.5-5% by weight and the amount of the third metal salt is 2-10% by weight, based on the total weight of the grease composition.

In another embodiment of the present invention use is made of two metal salts of different organic acids, a first metal salt of an organic acid which comprises 2-16 or 20-24 carbon atoms and a second metal salt of an organic acid metal salt which comprises 18 carbon atoms. The organic acid of the first metal salt is suitably butyric acid, caproic acid, caprylic acid, capric acid, lauric acid, myristic acid, palmitic acid, arachidic acid, behenic acid or lignoceric acid. The second metal salt is preferably prepared from 12-hydroxy stearic acid. As indicated before, the metal salt of 12-hydroxy stearic acid is able to form covalent bonds with OH-groups (silanol) of amorphous hydrophilic fumed silicon oxide, resulting in a very attractive performance of the grease composition in terms of thermal mechanical stability. Such a first metal salt is present in an amount in the range of from 0.1-15% by weight, more preferably in the range of from 0.5-8% by weight, and such a second metal salt is preferably present in an amount in the range of from 0.1-15% by weight, more preferably in the range of from 2-10% by weight, all weight percentages based on the total weight of the grease composition.

In yet another embodiment of the present invention, the grease composition comprises four types of metal salts of different organic acids. Accordingly, such a grease composition comprises a first metal salt of an organic acid, a second metal salt of an organic acid, a third metal salt of an organic acid, and a fourth metal salt of an organic acid, wherein the organic acids differ from each other. Preferably, the organic acid of the first metal comprises 2-16 carbon atoms, preferably 6-8 carbon atoms, the organic acid of the second metal salt comprises 20-24 carbon atoms, and the organic acids of the third and fourth metal salts each comprise 18 carbon atoms. The respective organic acids of the third metal salt and the fourth metal salt are preferably stearic acid and 12-hydroxy stearic acid. preferably 12-hydroxy stearic acid. The metal salt of 12-hydroxy stearic acid is able to form covalent bonds with OH-groups (silanol) of amorphous hydrophilic fumed silicon oxide, resulting in a very attractive performance of the grease composition in terms of thermal mechanical stability.

In a particularly attractive embodiment, the one or more metal salts of different organic acids to be used in accordance with the present invention have a relative polarity which is introduced by means of one or more double bonds along the organic acid chain, the introduction of an OH-group on a secondary position in the organic acid chain, or the introduction of another functional group within the organic acid such as an ester group or an aromatic group. Suitable examples of such metal salts are for instance metal salts of oleic acid (e.g. sodium oleate), and metal salts of ricinoleic acid (e.g. calcium ricinoleate). Metal salts of such organic acids have the advantage that they are able to form (additional) bondings with OH-groups (silanol) of amorphous hydrophilic fumed silicon oxide, resulting in a very attractive performance of the grease composition in terms of thermal mechanical stability.

The metal in the metal salt is preferably an alkali metal or an alkaline earth metal of Groups 1 and 2 of the Periodic System of Elements. Suitable examples of metals include lithium, potassium, sodium, calcium, aluminium, rubidium, cesium, francium, beryllium, strontium, barium, radium and magnesium. In addition it is noted that the metal in the metal salt to be used can be a semi-metal such as borium. According to a preferred embodiment according to the present invention, the metal is an alkaline earth metal, most preferably calcium.

The Base Oil

The nature of the base oil to be used in accordance with the present invention is not essential. The base oil may be selected from the group consisting of mineral base oils and synthetic base oils. Mineral base oils are derived from crude oils and are either formulated on the basis of aromatic, paraffinic and/or naphthenic base oils. Further, a wide range of synthetic base oils is known and they include esters, poly-α-olefins, polysiloxanes and the like.

The base oil to be used in accordance with the present invention may comprise a base oil blend. Suitably, blends of mineral base oils and synthetic base oils may be used. Preferably, the base oil or the base oil blend to be used in accordance with the present invention has a kinematic viscosity in the range of 1 to 60.000 cSt at a temperature of 40° C. according to DIN 51562/1.

Further Additives

The grease compositions may additionally comprise other thickening components, e.g. polymers or other organic compounds that contain one or more OH-groups and/or one or more unsaturated bonds and/or one or more ester groups and/or one or more aromatic groups. Such thickener compounds can suitably be present in an amount of less than 3% by weight, preferably less than 2% by weight, based on the total weight of the grease composition.

The grease compositions according to the present invention may comprise other additives to tailor its suitability to a certain use as is well known in the art. Such additives include anti-wear agents, anti-corrosion agents, rust inhibitors, friction modifiers, anti-oxidants, VI-improvers and the like as is well known by the person skilled in the art. Such other additives can suitably be present in an amount in the range of from 1-40% by weight, preferably 2-20% by weight, based on the total weight of the grease composition. In case the grease composition contains a high amount of such other additives, e.g. 20-40% by weight, based on total weight of the grease composition, the grease composition will display paste-type properties. Hence, the grease composition in accordance with the present invention also includes pastes. The other additives may also include small amounts (less than 3% by weight, preferably less than 2% by weight, based on the total weight of the grease composition) of further metal salts of organic acids, but such metal salts will not substantially contribute to the formation of the grease thickener. In that case the grease composition will contain more than four metal salts of different organic acids.

The Method for Manufacturing the Grease Composition

A common disadvantage of conventionally manufacturing methods is that it requires a multiple number of hours for blending the various components, gelling and cooling of the grease composition. At a batch scale of about 1-5 metric tons, the total cooking (gelling) and cooling can take about four hours or more, whereas grease milling can require two or more hours. Usually, the total manufacturing time takes about eight hours. However, the method according to the present invention can be performed in a very short manufacturing process, wherein blending, gelling and cooling is preferably performed within one hour, more preferably within half an hour period. The mechanical treatment, preferably grease milling, in accordance with the present invention for a 5 metric ton volume can require about two or two and a half hours. In addition, it is observed that conventional grease manufacturing processes are carried out at high temperatures, typically in the range of from 170-220° C., whereas the present grease composition can suitably be prepared at a temperature below 90° C., including room temperature.

The present invention also provides methods for preparing the present grease composition. In accordance with the present invention the components of the grease compositions can be mixed in any possible order of sequence. Preferably, the one or more metal salts of organic acids and/or the amorphous hydrophilic silicon particles, are subjected to a mechanical treatment, a thermal treatment or to both a mechanical treatment and a thermal treatment. Hence, (a) the amorphous hydrophilic silicon oxide particles or the one or more metal salts of different organic acids can be subjected to a mechanical treatment and/or thermal treatment; (b) a mixture of the one or more metal salts of different organic acids and the amorphous hydrophilic silicon oxide particles is subjected to a mechanical treatment and/or thermal treatment; or (c) a mixture of the base oil, the amorphous hydrophilic silicon oxide particles and the one or more metal salts of different organic acids is subjected to a mechanical treatment and/or thermal treatment. Preferably, the amorphous hydrophilic silicon oxide particles, the one or more metal salts of different organic acids or a mixture thereof is before or after mixing with the other component(s) subjected to a mechanical treatment, a thermal treatment or to both a mechanical treatment and a thermal treatment.

In accordance with the present invention the entire amount of base oil to be used or parts of the base oil can, for example, be added at one or more stages of the process. Suitable embodiments of the present invention include:

- Subjecting a mixture of one or more of the metal salts and the amorphous hydrophilic silicon oxide particles to a mechanical and/or thermal treatment, followed by adding to the mixture so obtained the base oil and optionally any further additives, and subjecting the grease composition so obtained to a mechanical and/or thermal treatment.
- Subjecting a mixture of one or more of the metal salts, the amorphous hydrophilic silicon oxide particles and a part of the base oil to a mechanical and/or thermal treatment, followed by adding to the mixture so obtained the remaining part of the base oil and optionally any further additives, and subjecting the grease composition so obtained to a mechanical and/or thermal treatment.
- Subjecting a mixture of one or more of the metal salts, the amorphous hydrophilic silicon oxide particles and the base oil to a mechanical and/or thermal treatment, followed by adding to the mixture so obtained any further additives, and subjecting the grease composition so obtained to a mechanical and/or thermal treatment.
- Subjecting a mixture of the base oil, the amorphous hydrophilic silicon oxide particles and one or more of the metal salts, and optionally any further additives, to a mechanical and/or thermal treatment.
- Subjecting the amorphous hydrophilic silicon oxide particles to a mechanical and/or thermal treatment of, followed by adding one or more of the metal salts to the silicon oxide particles so obtained and subjecting the mixture so obtained subsequently to a mechanical and/or thermal treatment. The base oil and optionally any further additives are then added to the mechanically and/or thermally treated mixture and the grease composition so obtained is then subjected to a mechanical and/or thermal treatment.
- Subjecting the amorphous hydrophilic silicon oxide particles to a mechanical and/or thermal treatment, followed by adding the base oil, one or more of the metal salts and optionally any further additives, to the mechanically and/or thermally treated silicon oxide particles, and subjecting the grease composition so obtained to a mechanical and/or thermal treatment.
- Subjecting one or more of the metal salts to a mechanical and/or thermal treatment, followed by adding the base oil, the amorphous hydrophilic silicon oxide particles and optionally any further additives to the at least one metal salt so obtained, and subjecting the grease composition so obtained to a mechanical and/or thermal treatment.

Subjecting one or more of the metal salts to a mechanical and/or thermal treatment of, followed by adding the amorphous hydrophilic silicon oxide particles to the mechanically and/or thermally treated metal salt(s) and subjecting the mixture so obtained subsequently to a mechanical and/or thermal treatment. The base oil and optionally any further additives are then added to the mechanically and/or thermally treated mixture and the grease composition so obtained is then subjected to a mechanical and/or thermal treatment.

As indicated above, the grease composition may comprise any further additives. Such further additives can be added to one or more of the components at any stage of the preparation process of the grease composition.

In the process according to the present invention each of the components or any mixture of the components can be subjected to a mechanical and/or thermal treatment in any possible order of sequence. For example, all components can be added together after which the mechanical and/or thermal treatment is applied. One of the components (e.g. the amorphous hydrophilic silicon particles) can first be subjected to a mechanical and/or thermal treatment after which one other component (e.g. a metal salt) or two or more other components (i.e. one or more of the metal salts and the base oil) can be added to the mechanically and/or thermally treated component, followed by subjecting the grease composition so obtained to a mechanical and/or thermal treatment. Alternatively, one of the components (e.g. the amorphous hydrophilic silicon particles) can first be subjected to a mechanical and/or thermal treatment after which one other component (e.g. a metal salt) can be added to the mechanically and/or thermally treated component, subjecting the mixture so obtained to a further mechanical and/or thermal treatment, followed by adding yet one or more other components (e.g. the base oil and an optionally another metal salt) to the mechanically and/or thermally treated mixture so obtained, and subjecting the grease composition thus obtained to a mechanical and/or thermal treatment.

According to one embodiment of the present invention, the amorphous silicon oxide hydrophilic particles are first subjected to a mechanical treatment, a thermal treatment or to both a mechanical treatment and a thermal treatment. Subsequently, the amorphous hydrophilic silicon oxide particles so obtained are mixed with the base oil and the one or more metal salts of different organic acids to form a grease composition.

Hence, the present invention also relates to a method for manufacturing a grease composition according to the present invention, which method comprises the following sequential steps:

(a) subjecting the amorphous hydrophilic silicon oxide particles to a mechanical treatment, a thermal treatment or to both a mechanical treatment and a thermal treatment; and (b) mixing the amorphous hydrophilic silicon oxide particles so obtained with the base oil and one or more metals salts of different organic acids to form a grease composition.

In case use is made of a plurality of metal salts of different organic acids, the metal salts may optionally be processed together with the amorphous hydrophilic silicon oxide particles in step (a).

According to another embodiment of the present invention, the amorphous hydrophilic silicon oxide particles are first mixed with the base oil and the one or more metal salts of different organic acids to form a grease composition, whereafter the grease composition so formed is subjected to the mechanical treatment, the thermal treatment or to both the mechanical treatment and the thermal treatment.

Accordingly, the present invention also relates to a method for manufacturing a grease according to the present invention, which method comprises the following sequential steps:

(a) mixing the amorphous hydrophilic silicon oxide particles with the base oil and the one or more metal salts of different organic acids to form a grease composition; and (b) subjecting the grease composition so formed to a mechanical treatment, a thermal treatment or to both a mechanical treatment and a thermal treatment.

The mechanical treatment is preferably a milling step which can be performed in any suitable milling apparatus, e.g. a high pressure homogeniser, a colloid mill, a three-roller mill (e.g. a three-roller mill) or a worm gear mill. Preferably, the milling apparatus is a worm gear milling apparatus. The milling step can be performed under inert conditions, i.e. in the absence of air or oxygen and/or in the absence of water (vapour). The thermal treatment is preferably a heating step. The heating step preferably involves heating at a temperature in the range of 30-120° C., more preferably 40-110° C. and in particular 45-90° C. In this heating step, the water content of the amorphous silicon oxide particles is reduced, preferably to a water content of the silicon oxide particles of less than 5% by weight, more preferably less than 1% by weight, even more preferably less than 0.5% by weight, yet even more preferably less than 0.25% by weight, based on the total weight of the silicon oxide particles. The water content of the amorphous silicon oxide particles is usually more than 0.01% by weight, based on the total weight of the silicon oxide particles.

Most preferably, the grease composition is manufactured by optionally subjecting the amorphous silicon oxide particles to a thermal treatment, preferably a heating step, to reduce the water content of the amorphous silicon oxide particles, followed by mixing the amorphous silicon oxide particles with the base oil and the one or more metal salts of different organic acids to form a grease composition, whereafter the grease composition so formed is subjected to a mechanical treatment, preferably a milling step.

Composition of the Grease Composition

As disclosed above, the grease composition according to the present invention comprises a base of and a thickener which comprises amorphous hydrophilic silicon oxide particles and one or more metal salts of different organic acids, wherein the amount of the metal salt(s) is 4-25% by weight, based on the total weight of the grease composition. Preferably, the amount of the metal salt(s) is 5-20% by weight, based on the total weight of the grease composition.

Preferably, the base oil is present in the grease composition in an amount of 50-95% by weight, based on the total weight of the grease composition. More preferably, the amount of the base oil is 70-90% by weight, and even more preferably 75-85% by weight, based on the total weight of the grease composition.

Suitably, the amorphous hydrophilic silicon oxide particles are present in the grease composition in an amount of 0.1-10% by weight, based on the total weight of the grease composition. Preferably, the amount of the amorphous hydrophilic silicon oxide particles is 1-8% by weight, more preferably 1-5% by weight, based on the total weight of the grease composition.

The total amount of the amorphous hydrophilic silicon oxide particles and the one or more metal salts of different organic acids is preferably 5-30% by weight, based on the total weight of the grease composition. More preferably, the total amount of the amorphous hydrophilic silicon oxide particles and the one or more metal salts of different organic acids is 8-20% by weight, based on the total weight of the grease composition.

Applications

The grease composition according to the present invention can be used in many applications including food applications. However, it is in particular useful for lubricating a bearing, preferably a rolling element bearing, e.g. a spherical roller bearing, a taper roller bearing, a cylindrical roller bearing, a needle roller bearing, a ball bearing, and may also be used to lubricate a sliding or plain bearing. It is furthermore very useful in coupling and gearing applications. Hence, the present invention also relates to the use of the present grease composition for lubricating a bearing, a gearing or a coupling.

The grease compositions according to the present invention encompass NLGI (National Lubricating Grease Institute) grades ranging from NLGI grade 000 to NLGI grade 6. Preferably, the grease compositions according to the present invention have a dropping point of at least 70° C. up to about 200° C. according to ASTM D-2265.

When used in low loading gearings, the grease composition has preferably a NLGI grade of 000 to 1. When used in high loading gearings, the grease composition has preferably a NLGI grade of 0 to 2. When used in bearings, the grease composition has preferably a NLGI grade of 1 to 4, more preferably a NLGI grade of 2 or 3 and most preferably a NLGI grade of 2.

The present invention will now be illustrated by means of the following examples, which do not limit the invention in any way.

EXAMPLES

Example 1

5 kg of a grease composition comprising 5.0% by weight of Aerosil® 200 (a hydrophilic fumed silica), 80% by weight of mineral oil of ExxonMobil, 68 cSt at 40° C. and 10% of calcium-12-hydroxystearate, based on the total weight of the final grease consumption (100% by weight), was prepared by mixing all ingredients during 10 minutes. The mixture so obtained was then milled for 30 minutes at room temperature using a three-roller mill. The grease composition obtained was then heated to 80° C. during 3 hours. Subsequently, the following ingredients were mixed at room temperature during 10 minutes with the grease so obtained to form the final grease composition: (a) 2% by weight calciumhydrogenphosphate (Merck), (b) 0.5% by weight benzotriazole of Ciba, (c) 0.5% by weight irgalub 349 (mono- and dialkylphosphateamines) of Ciba, (d) 0.5% by weight triphenylphosphorothionate of Ciba, and (e) 1.5% by weight sodium sebac acid, based on total weight of the final grease composition Finally, the grease composition so formed was milled for 30 minutes at room temperature using a three-roller mill.

The performance of this grease composition in various tests is shown in Table 1.

TABLE 1

| Test method | Test Standard | Test Result |
|---|---|---|
| Copper corrosion, 100° C. | DIN 51811 | 1b |
| Copper corrosion, 120° C. | DIN 51811 | 1b |
| Emcor, distilled water | DIN 51802, IP 220 | 1-2 |
| Emcor 1.5% wt., sea water | DIN 51802, IP 220 | 1-2 |
| Dropping point [° C.; ° F.] | DIN ISO 2176 | 270; 518 |
| Low temperature torque [mNm], start, running | IP 186 | 186; 106 |

Example 2

5 kg of a grease composition comprising 2.5% by weight of Aerosil® 200, 86% by weight of mineral oil of ExxonMobil, 68 cSt at 40° C., 4% by weight of calcium-12-hydroxystearate and 4% by weight of calcium stearate, based on the total weight of the final grease composition (100% by weight), was prepared by mixing all ingredients at room temperature during 10 minutes. The mixture so obtained was then milled at room temperature for 30 minutes using a three-roller mill. The grease composition obtained was then heated to 80° C. during 3 hours. Subsequently, the following ingredients were mixed at room temperature during 10 minutes with the grease composition so obtained to form the final grease composition: (b) 0.5% by weight benzotriazole of Ciba, (c) 0.5% by weight irgalub 349 (mono- and dialkylphosphateamines) of Ciba, (d) 0.5% by weight triphenylphosphorothionate of Ciba, and (e) 2% by weight sodium sebac acid, based on the total weight of the final grease composition. Finally, the grease composition so formed was milled for 30 minutes at room temperature using a three-roller mill.

The performance of this grease composition in various tests is shown in Table 2.

TABLE 2

| Test method | Test Standard | Test Result |
|---|---|---|
| Copper corrosion, 100° C. | DIN 51811 | 1b |
| Emcor, distilled water | DIN 51802, IP 220 | 1-2 |
| Emcor 1.5% wt., sea water | DIN 51802, IP 220 | 1-2 |
| Dropping point [° C.; ° F.] | DIN ISO 2176 | >246; >474.8 |

Example 3

5 kg of a grease composition comprising 2.5% by weight of Aerosil® 200, 77% by weight of mineral oil of ExxonMobil, 68 cSt at 40° C., 5% by weight of calcium-12-hydroxystearate, 5% by weight of calcium stearate and 7% by weight of calcium behenate, based on the total weight of the final grease composition (100% by weight), was prepared by mixing all ingredients at room temperature during 10 minutes. The mixture so obtained was then milled at room temperature for 30 minutes using a three-roller mill. The grease composition obtained was then heated to 80° C. during 3 hours. Subsequently, the following ingredients were mixed at room temperature during 10 minutes with the grease composition so obtained to form the final grease composition: (a) 0.5% by weight benzotriazole of Ciba, (b) 0.5% by weight irgalub 349 (mono- and dialkylphosphateamines) of Ciba, (c) 0.5% by weight triphenylphosphorothionate of Ciba, and (d) 2% by weight sodium sebac acid, based on the total weight of the final grease composition. Finally, the grease composition so formed was milled for 30 minutes at room temperature using a three-roller mill.

The performance of this grease composition in various tests is shown in Table 3.

TABLE 3

| Test method | Test Standard | Test Result |
|---|---|---|
| Copper corrosion, 100° C. | DIN 51811 | 1b |
| Dropping point [° C.; ° F.] | DIN ISO 2176 | >220; >464 |

Example 4

5 kg of a grease composition comprising 5.0% by weight of Aerosil® 200, 77% by weight of a poly-α-olefin (40 cSt. at 40° C.), 15% by weight of calcium stearate, 0.3% by weight of Ciba Irgalub 349 (mono- and di-alkylphosphateamines), 1.0% by weight of Rhein Chemie 2410, 0.2% by weight of Ciba Irgamed 39, 0.5% by weight of Rhein Chemie 3760 and 1.0% by weight of Rhein Chemie 3560, based on the total weight of the final grease composition (100% by weight), was prepared by mixing all ingredients during 10 minutes at room temperature. The mixture so obtained was then milled for 30 minutes at room temperature using a three-roller mill.

The grease composition so prepared was subjected to a full bearing test. The bearing test was run under the conditions of medium speed, low bearing load, and medium to high bearing temperatures. The bearing test was run under the specification of FE 8 DIN 51819. The Fe8 test is used to perform a mechanical-dynamical test for lubricants and greases. The test reveals the capability of lubricants and greases to provide lubricating properties and wear protection to the roller bearing under the specific mechanical and dynamical loading conditions. The Fe8 test-bench equipped with two angular contact ball bearings, 7312. The two bearings are spring loaded and consequently apply a test load of 10 kN. The test bearings are equipped on the outer ring of the test bearings with thermocouples to measure the running temperature of the bearings. The friction torque is measured through a sensor. The test bearings are mounted on a rotating shaft driven by an electromotor through a reduction gear unit which realizes a test speed of 1500 rpm. The test bearing 7312 has the dimensions shown in Table 4.

TABLE 4

| 7312 dimensions | |
|---|---|
| Outer ring diameter D [mm] | 130 |
| Inner diameter d [mm] | 60 |
| Mean diameter Dm [mm] | 95 |
| Bearing width B [mm] | 31 |

The full bearing test was performed under the operating conditions as specified in Table 5.

TABLE 5

| Test condition | |
|---|---|
| Axial load [kN] | 10 |
| Speed [rpm] | 1500 |
| Grease amount, each bearing [ml] | 65 |
| Constant testing temperature [° C.; ° F.] | 120; 248 |
| Cage material | polyamide |
| Testing time [h] | 750 |

The test revealed a very low friction coefficient. The test was suspended after 750 h of running. The grease composition passed the test with a very good wear result: less than 10 mg of wear was measured. The bearings did not show any pittings.

The grease composition was also subjected to a second full bearing test. The second bearing test was run under conditions of low to very low bearing speed, high bearing load, and medium bearing temperature. The bearing test was run under the specification of FE 8 DIN 51819. The Fe8 test-bench is equipped with two tapered roller bearings. The two test bearings are spring loaded and consequently apply a test load of 80 kN. The self-regulating temperature through fan-cooling is about 80° C. The test bearings are equipped on the outer ring with thermocouples to measure the running temperature of the bearings. The friction torque is measured through a sensor. The test bearings are mounted on a rotating shaft driven by an electromotor through a reduction gear unit which realizes a test speed of 75 rpm. The test bearing 31312 has the dimensions. As shown in Table 6.

TABLE 6

| 31312 dimensions | |
|---|---|
| Outer ring diameter D [mm] | 130 |
| Inner diameter d [mm] | 60 |
| Mean diameter Dm [mm] | 103.8 |
| Bearing width B [mm] | 31 |

The test was performed under the operating conditions as specified in Table 7.

TABLE 7

| Test condition | |
|---|---|
| Axial load [kN] | 80 |
| Speed [rpm] | 75 |
| Grease amount, each bearing [ml] | 200 |
| Constant testing temperature [° C.; ° F.] | 80; 176 |
| Cage material | steel |
| Testing time [h] | 500 |

The test revealed that the friction torque was remaining on a low level despite of a small increase around 350 testing hours. The grease passed the test with a low bearing friction torque and moderate wear.

Example 5

A grease composition was prepared in accordance with Example 4, except that additives Rhein Chemie 2410 and Rhein Chemie 3560 were replaced by an amount of 0.5% by weight of a triphenylphosphorothionate (Ciba), and that the grease composition comprises 78.5% by weight of the poly-α-olefin.

The grease composition so prepared was subjected to the tests that are specified in Table 8. The test results obtained are also shown in Table 8.

TABLE 8

| Test method | Test Standard | Test Result |
|---|---|---|
| Water resistance | DIN 51807/1 | 1-2 |
| Copper corrosion, 100° C. | DIN 51811 | 0-0 |
| Copper corrosion, 120° C. | DIN 51811 | 0-0 |
| Copper corrosion, 140° C. | DIN 51811 | 1-1 |
| Emcor, distilled water | DIN 51802, IP 220 | 0-0 |
| Emcor 1.5% wt., sea water | DIN 51802, IP 220 | 1-1 |
| Emcor 3.0% wt., sea water | DIN 51802, IP 220 | 2-2 |

TABLE 8-continued

| Test method | Test Standard | Test Result |
|---|---|---|
| Four ball wear scar [mm] | ASTM D 4172 | 0.5 |
| Four ball weld load [N] | ASTM D 4172 | 2200 |

Example 6

A grease composition was prepared in accordance with Example 4, except that additives Rhein Chemie 2410 and Rhein Chemie 3560 were replaced by an amount of 0.05% by weight of a molybdenum dithiophosphonate (RT Vanderbilt), the grease composition comprises 78% by weight of the poly-α-olefin and that an ester oil (Fuchs; 120 cSt. at 40° C.) was added (0.95 wt. %).

The grease composition so prepared was subjected to the tests that are specified in Table 9. The test results obtained are also shown in Table 9.

TABLE 9

| Test method | Test Standard | Test Result |
|---|---|---|
| Water resistance | DIN 51807/1 | 0-0 |
| Copper corrosion, 100° C. | DIN 51811 | 2-2 |
| Emcor, distilled water | DIN 51802, IP 220 | 2-2 |
| Four ball wear scar [mm] | ASTM D 4172 | 2.6 |
| Four ball weld load [N] | ASTM D 4172 | 2400 |

Example 7

5 kg of a grease composition comprising 3.5% by weight of Aerosil® 200, 79% by weight of mineral oil of ExxonMobil, 68 cSt at 40° C., 12% by weight of calcium-12-hydroxystearate, and 0.5% by weight benzotriazole of Ciba, 0.5% by weight irgalub 349 (mono- and dialkylphosphateamines) of Ciba, 3% by weight triphenylphosphorothionate of Ciba, and 1.5% by weight sodium sebac acid, based on the total weight of the final grease composition (100% by weight), was prepared by mixing all ingredients during 10 minutes at room temperature. Subsequently, the grease composition so obtained was heated at 80° C. for 3 hours, followed by milling by means of a three-roller-mill during 30 minutes at room temperature.

The performance of this grease composition in various tests is shown in Table 10.

TABLE 10

| Test method | Test Standard | Test Result |
|---|---|---|
| Copper corrosion, 100° C. | DIN 51811 | 1b |
| Work penetration | DIN ISO 2137 | 265-295 |
| Dropping point [° C.; ° F.] | DIN ISO 2176 | >220; >464 |

Example 8

A grease composition comprising 2.0% by weight of Aerosil® 200, 50% by weight of mineral oil of ExxonMobil, 68 cSt at 40° C., 4% by weight of calcium-12-hydroxystearate, and 4% by weight of calcium stearate, based on the total weight of the final grease composition (100% by weight), was prepared by mixing all ingredients during 10 minutes at room temperature. The mixture so obtained was then milled during 30 minutes at room temperature using a three-roller-mill. Subsequently, the mixture so obtained was heated at 80° C. for 6 hours. Subsequently, the following additives were added at room temperature to the grease composition so obtained: (a) 0.5% by weight benzotriazole of Ciba, (b) 0.5% by weight irgalub 349 (mono- and dialkylphosphateamines) of Ciba, (c) 0.5% by weight triphenylphosphorothionate of Ciba, (d) 2% by weight sodium sebac acid and 36.5% by weight of the mineral oil of ExxonMobil, 68 cSt at 40° C., based on total weight of the final composition. Subsequently, the grease composition so obtained was milled during 30 minutes at room temperature using a three-roller mill.

The performance of this grease composition in various tests is shown in Table 11.

TABLE 11

| Test method | Test Standard | Test Result |
|---|---|---|
| Copper corrosion, 100° C. | DIN 51811 | 1b |
| Work penetration | DIN ISO 2137 | 265-295 |
| Dropping point [° C.; ° F.] | DIN ISO 2176 | >220; >464 |

From the results shown in the above Tables it will be clear that the grease compositions according to the present invention that contain the present particular thickener display very attractive properties, and that they can be prepared at surprisingly low temperatures and in a very easy and thus attractive manner.

The invention claimed is:

1. A non-hydroxide grease composition comprising:

a base oil, 1-5% by weight, based on the total weight of the grease composition, amorphous hydrophilic silicon oxide particles, and one or more metal salts of different organic acids in a non-saponified state, the metal salt(s) being selected from the group consisting of calcium stearate and calcium 12-hydroxystearate, wherein:

the silicon oxide particles have a BET specific surface area of at least 50 $m^2/g$ and at least 80% of the silicon oxide particles have a mean particle size of 5-50 nm, the amount of the metal salt(s) is 4-20% by weight, based on the total weight of the grease composition, with the proviso that the total amount of the amorphous hydrophilic fumed silicon oxide particles and the one or more metal salts of different organic acids is 8-25% by weight, based on the total weight of the grease composition, the base oil is mineral oil and/or poly-α-olefin, the base oil is present in the grease composition in an amount of 70-90 wt % by weight based upon the total weight of the grease composition, and the grease composition has a dropping point higher than 220° C. and contains less than 0.2 wt % of free hydroxide ions and/or metal hydroxide.

2. The grease composition according to claim 1, wherein the one or more metal salts are substantially pure metal salts.

3. The grease composition according to claim 1, wherein the silicon oxide particles are amorphous hydrophilic fumed silicon oxide particles.

4. The grease composition according to claim 1, comprising only one type of metal salt of an organic acid.

5. The grease composition according to claim 4, wherein the metal salt is only calcium stearate.

6. The grease composition according to claim 1, wherein the grease composition comprises:

calcium stearate, and calcium 12-hydroxystearate.

7. The grease composition according to claim 1, wherein the grease composition contains less than 0.1% by weight of free hydroxide ions and/or metal hydroxide, based on the total weight of the grease composition.

8. The grease composition according to claim 4, wherein the metal salt is only calcium-12-hydroxystearate.

9. The grease composition according to claim 1, wherein the amount of the metal salt(s) is 5-20% by weight, based on the total weight of the grease composition.

10. The grease composition according to claim 9, wherein the grease composition contains less than 0.1% by weight of free organic acids, based on the total weight of the grease composition.

11. The grease composition according to claim 1, wherein the base oil is only poly-α-olefin.

12. A grease prepared by mixing, in weight percent based upon the total weight of the grease:

70-90 wt % mineral oil and/or poly-α-olefin, 1-5 wt % amorphous hydrophilic fumed silicon oxide particles having a BET specific surface area of at least 50 $m^2/g$ and, at least 80% of the silicon oxide particles having a mean particle size of 5-50 nm, and 5-20 wt % at least substantially pure calcium stearate and/or calcium 12-hydroxystearate, with the proviso that the total amount of the amorphous hydrophilic fumed silicon oxide particles and the calcium stearate and/or calcium 12-hydroxystearate is 8-20 wt %, wherein the grease composition has a dropping point higher than 220° C. and contains less than 0.2 wt % of free hydroxide ions and/or metal hydroxide.

* * * * *